US005131333A

United States Patent [19]

Karasawa et al.

[11] Patent Number: 5,131,333

[45] Date of Patent: Jul. 21, 1992

[54] TILTABLE TABLE

[75] Inventors: Ryuji Karasawa, Hiroshima; Kenko Yamaga, Amagasaki; Yoshikazu Tabayashi, Suita, all of Japan

[73] Assignee: Osaka Taiyu Co., Ltd., Osaka, Japan

[21] Appl. No.: 699,986

[22] Filed: May 13, 1991

[30] Foreign Application Priority Data

May 15, 1990 [JP] Japan ..... 2-51397[U]

[51] Int. Cl.[5] ..... A47F 5/12

[52] U.S. Cl. ..... 108/7; 108/1

[58] Field of Search ..... 108/1, 2, 4, 6, 7, 9, 108/138, 10, 147; 248/371, 372.1, 398

[56] References Cited

U.S. PATENT DOCUMENTS

| | | | |
|---|---|---|---|
| 3,347,399 | 10/1967 | Ensinger | 108/6 X |
| 4,180,002 | 12/1979 | Huempfner | 108/6 |
| 4,337,670 | 7/1982 | Carlson | 108/7 X |
| 4,703,701 | 11/1987 | Sema | 108/138 X |
| 4,714,028 | 12/1987 | Uredat-Neuhoff | 108/138 X |
| 4,879,954 | 11/1989 | Sawamura et al. | 108/1 X |

FOREIGN PATENT DOCUMENTS

| | | |
|---|---|---|
| 3815809 | 11/1988 | Fed. Rep. of Germany . |
| 8813003 | 2/1990 | Fed. Rep. of Germany . |
| 2599774 | 12/1987 | France . |
| 7812330 | 6/1980 | Netherlands . |

*Primary Examiner*—Jose V. Chen

*Attorney, Agent, or Firm*—Arnold B. Silverman

[57] ABSTRACT

A tiltable table having a top plate tiltably mounted on a frame. The tiltable table comprises an air spring disposed between the frame and the top plate and having a cylinder pivoted at its one end to the frame, a piston rod pivoted at its outer end to the rear side of the top plate and a release pin projecting from the piston rod outer end, the piston rod being holdable as projected by a desired length by the air spring; a pushing plate movable toward and away from the release pin of the air spring; a lever pivoted to the top plate at the free end thereof; and release structure attached at its one end to the base end of the lever and at the other end thereof to the pushing plate for pressing the pushing plate into contact with the release pin of the air spring when the lever is pivotally moved to thereby release the piston rod from the holding action of the air spring.

3 Claims, 7 Drawing Sheets

TILTABLE TABLE

FIELD OF INDUSTRIAL APPLICATION

The present invention relates to improvements in a tiltable table which is usable as a projector table or work table.

BACKGROUND OF THE INVENTION

The tiltable table has a top plate which can be tilted at a desired variable angle and fixed at a predetermined tilt angle for supporting a projector or like heavy article placed on the top plate. It is required that the tiltable table have strength sufficient to support the heavy article at the desired tilt angle. However, it has been difficult to provide mechanisms having such functions within a narrow space on the rear side of the top plate.

SUMMARY OF THE INVENTION

An object of the present invention is to provide a tiltable table which is provided in a space on the rear side of its top plate with a mechanism for holding the top plate in a tilted position and a mechanism for releasing the top plate from the holding mechanism and setting the top plate at a desired angle.

Another object of the present invention is to provide a tiltable table having a mechanism which enables the user to feel a snap through a handle upon the top plate tilting to the position of a predetermined angle, e.g., a horizontal position, thus permitting the user to recognize the horizontal position.

Still another object of the present invention is to provide a mechanism for preventing the top plate from inadvertently tilting to an altered angle.

Figure 2A:
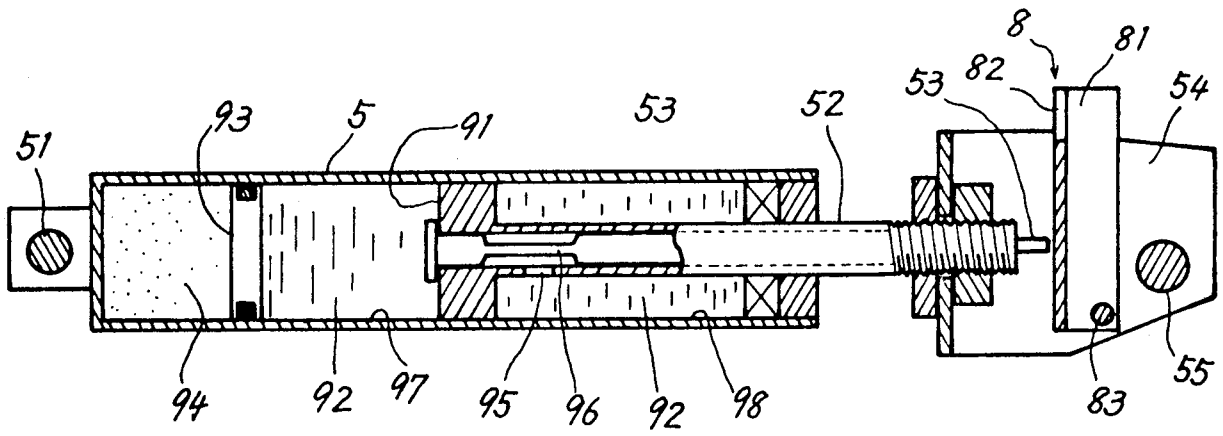
FIG. 2 is an enlarged view in section showing a holding mechanism and a release mechanism for a top plate.
Figure 2:
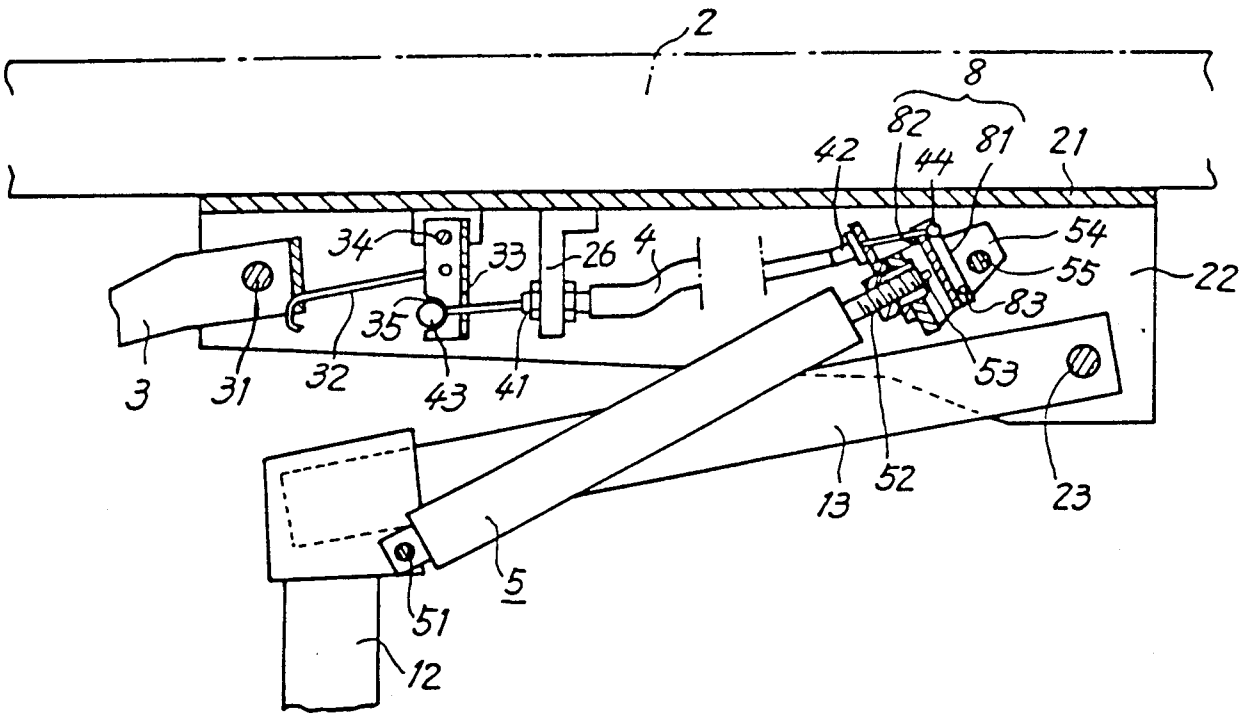
Figure 3:
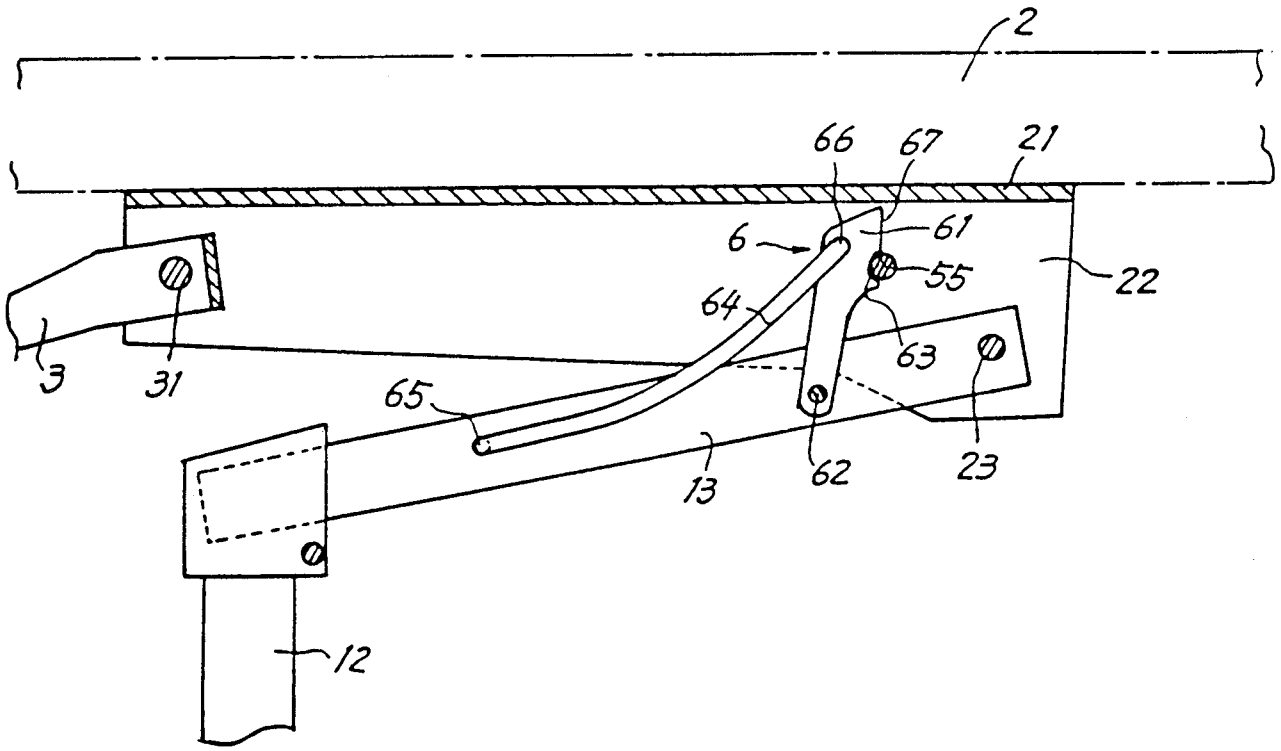
Figure 4:
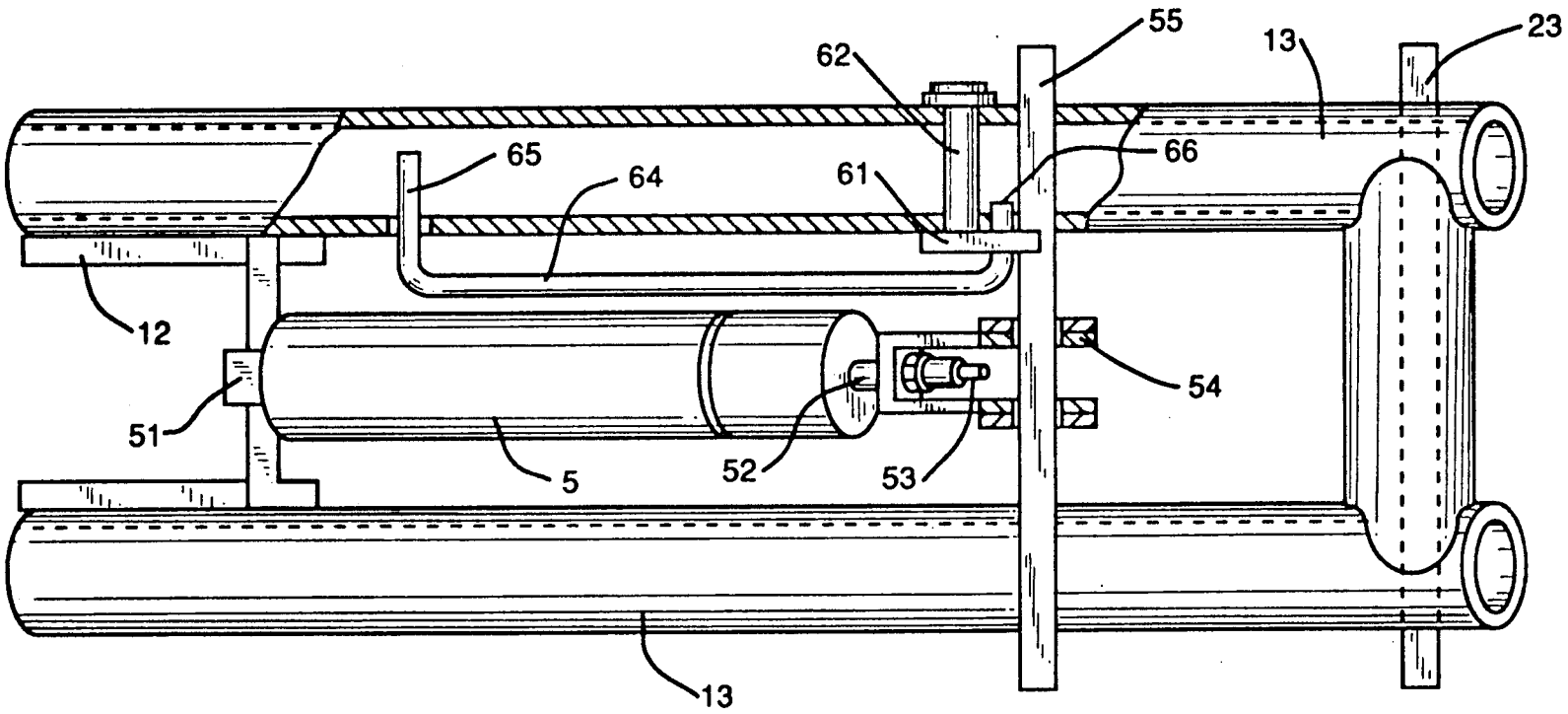
Figure 5:
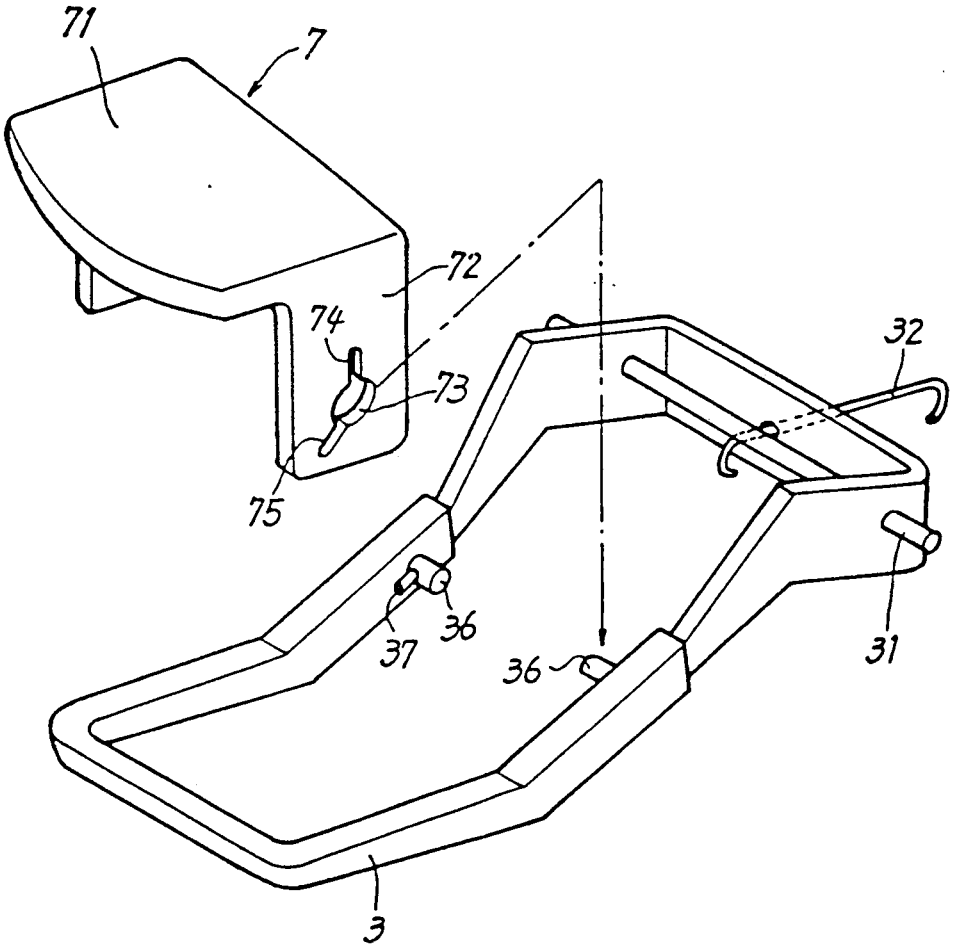

FIG. *2a* is an enlarged view in section of an air spring shown in FIG. 2;

FIG. 3 is an enlarged front view showing the construction of a pawl plate with the holding and release mechanisms omitted;

FIG. 4 is a plan view showing a frame assembly with the top plate and a bracket removed;

FIG. 5 is a perspective view showing a lever and a lock member; and

Figure 6:
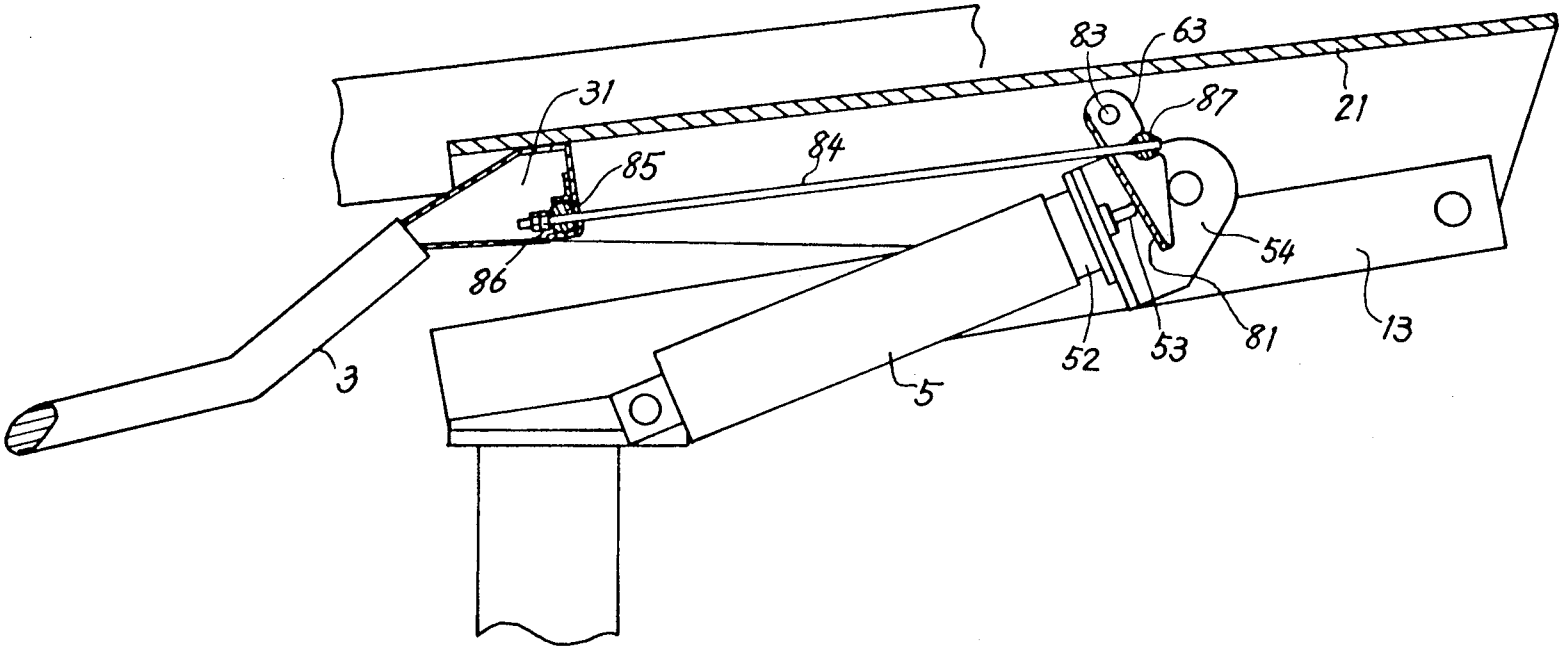

FIG. 6 is an enlarged view in section showing another embodiment of top plate release mechanism.

DETAILED DESCRIPTION OF THE INVENTION

Figure 1:
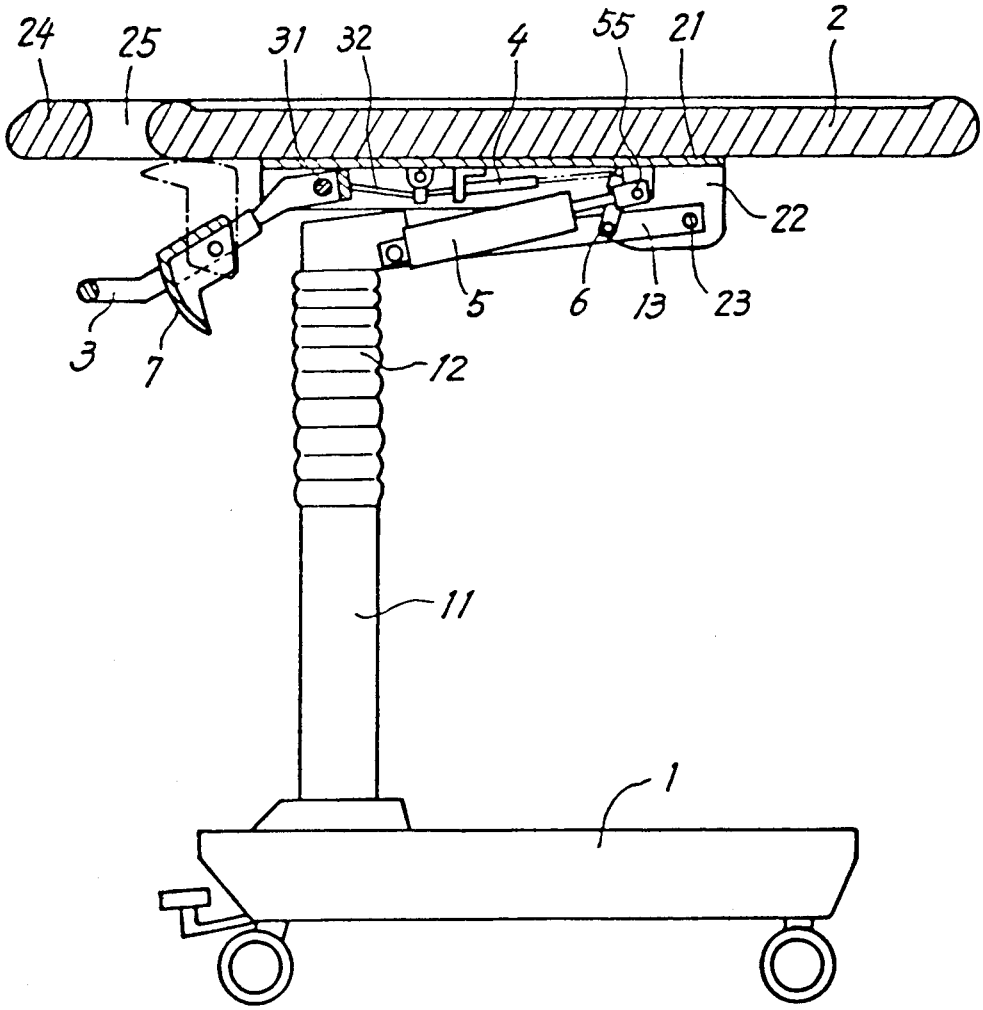
FIG. 1 is a front view of a tiltable table embodying the invention.

With reference to FIG. 1 showing a tiltable table embodying the invention, a lift mast 12 is upwardly and downwardly movably mounted on a fixed post 11 extending upward from a dolly 1. Two frames 13 extend in parallel from the upper end of the lift mast 12 as an assembly. A top plate 2 has a bracket 21 on its rear side. A pivot 23 extends through the forward ends of the frames 13 and the corresponding ends of side plates 22 of the bracket 21 to movably support the top plate 2 on the forward portion of assembly of the frames 13.

Holding Mechanism

A pivot 55 extends through the side plates 22 of the bracket 21. An air spring 5 is disposed between the pivot 55 and the lift mast 12. The air spring 5 has one end 51 pivoted to the mast 12, and a piston rod 52 projecting from the air spring has fixed to its outer end a bracket 54, which in turn is supported by the pivot 55. Consequently, the tilt angle of the top plate 2 can be set and fixed by determining the length of projection of the piston rod 52 from the cylinder as desired and locking the piston rod at the projected position.

With reference to FIG. *2a*, the air spring 5 is a commercial one and has in its interior a piston 91, compressed gas 94, working fluid 92, release valve 96 and free piston 93. A first chamber 97 and a second chamber 98 on opposite sides of the piston 91 are filled with the working fluid 92. The release valve 96 usually holds an orifice 95 in the piston 91 closed, preventing the flow of the working fluid 92 and locking the piston 91 inside the cylinder, so that the length of projection of the piston rod 52 remains unchanged.

When the outer end of a pin 53 projecting from the outer end of the piston rod 52 is pushed by a pushing plate 81, the release valve 96 opens the orifice 95, permitting the working fluid to freely flow between the first chamber 97 and the second chamber 98 on opposite sides of the piston 91 to render the piston 91 free to move. The piston 91 is moved by the expansion of the compressed gas 94 or by pushing in the outer end of the piston rod 52. When the pin 53 is relieved of the pressure, the piston 91 is locked in the moved position to set the piston rod 52 in the projected position.

Release Means

The bracket 54 fixed to the piston rod outer end is provided with release means 8 opposed to the pin 53 of the air spring 5.

As seen in FIG. 2, the release means 8 interconnects the pushing plate 81 and a lever 3 attached to the free end of the top plate 2.

The free end of the top plate 2 is provided with a handle 24 with a hole 25 formed therebetween. The lever 3 is attached at its base end to the rear side of the top plate by a pivot 31 close to the handle 24 and has a forward end extending toward the handle 24.

With reference to FIG. 2, the base end of the lever 3 is connected by a link member 32 to a pivotal plate 33 pivoted to the bracket 21 as at 34. The pivotal plate 33 is coupled to the pushing plate 81 of the release means 8 by a remote flexible wire 4.

The flexible wire 4 comprises an outer tube and an inner wire member. The outer tube has one end 41 fixed to a bracket 26 close to the pivotal plate 33, and the other end 42 fixed to the bracket 54.

The inner wire member has one end 43 engaged in a recessed portion 35 of the pivotal plate 33, and the other end 44 engaged in a cutout 82 formed in one end of the pushing plate 81. Accordingly, the remote flexible wire 4 extends between the two brackets 26 and as passed between members adjacent thereto and bent as desired.

The lever 3 exerts a pulling force which increases in accordance with the ratio of the distance of the lever grip from the pivot 31 to the distance of the link member 32 from the pivot 31. The pressure to be exerted by the pushing plate 81 increases in accordance with the ratio of the distance of the cutout 82 from a pivot 83 to the distance of the outer end of the pin 53 from the pivot 83, the pushing plate 81 being attached to the bracket 54 by the pivot 83.

Horizontally Positioning Mechanism

As shown in FIGS. 3 and 4, one of the two parallel frames 13 is provided with a pivot 62 supporting the base end of a pawl plate 61.

The pawl plate 61 has a spring wire 64 having opposite ends which are bent at a right angle. One end 65 of the spring wire is engaged in the frame 13, and the other end 66 thereof is engaged in the pawl plate 61 to press a contact face 67 of the pawl plate 61 against the pivot 55. After the spring wire 64 has been engaged at its opposite ends in the frame and the pawl plate as shown in FIG. 4, the air spring 5 subsequently assembled is positioned alongside the spring wire 64 to prevent the spring wire 64 from slipping off. The contact face 67 of the pawl plate 64 is formed with a recess 63 which is positioned as opposed to the pivot 55 when the top plate 2 is in its horizontal position. When an upward force or downward force is applied to the top plate 2, with the handle 24 and the grip of the lever 3 grasped, the release valve 96 in the air piston 5 unlocks the piston 5, and the top plate freely moves pivotally. The user feels a snap through the handle 24 upon the recessed portion 63 of the pawl plate 61 fitting around the pivot 55. If the lever 3 is released from the hand at this time, the tiltable top plate 2 is held in the horizontal position.

Lock Mechanism

With reference to FIGS. 1 and 5, the lever 3 is provided with a lock member 7 which is L-shaped in section. The lock member 7 has opposite side plates 72 each formed with a deep bore 73 and two shallow positioning grooves 74, 75. The lever 3 is formed on the inner face of each side portion thereof with a pin 36 fittable in the bore 73 and a ridge 37 corresponding to the positioning grooves 74, 75. Accordingly, the lock member 7 is pivotally movable with each pin 36 fitted in the bore 73 between a standby position (indicated in solid line in FIG. 1) and a locking position (dot-and-dash line in FIG. 1) wherein a lock plate 71 is raised to bear on the rear side of the top plate 2. In these positions, the ridge 37 fits in either one of the two positioning grooves 74, 75. Since the lock plate 71 is held in its pivotally moved position by the engagement of the ridges 37 in the positioning grooves 74 or 75, the lever 3 is held locked by the lock member 7 and will not inadvertently become released. Thus, the lock member 7, when raised, prevents the manipulation of the lever 3, consequently rendering the release mechanism 3 inoperative and holding the top plate tilted.

Another Embodiment

FIG. 6 shows another embodiment of mechanism 8 for releasing the air piston.

The base end of a pushing plate 81 is pivoted as at 83 to the rear side of the bracket 21 on the top plate 2. The base end of the lever 3 and the pushing plate 81 is interconnected by a tie rod 84.

The end of the tire rod 84 toward the pushing plate 81 has an enlarged portion 87, which is engaged in a recessed portion 63 formed in the pushing plate 81. The other end of the tie rod 84 toward the lever extends through a retaining lateral rod 85, is threaded and has an adjusting nut 86 screwed thereon. According to the embodiment of FIG. 6, the position where the pin 53 of the air spring 5 bears on the pushing plate 81 alters with the tilt angle of the top plate, such that the distance of the point of application of force from the pivot 83 is minimum to give a small lever ratio when the length of projection of the piston rod 53 is minimum, i.e., when the gas confined in the cylinder is compressed most to give an increased pressure.

Further the distance of the point of application from the pivot 83 is maximum to give a great lever ratio when the length of projection of the piston rod is maximum, i.e., when the gas in the cylinder is most expanded to give a decreased pressure. Consequently, the force applied by manipulating the lever 3 to pull the tie rod 84 is approximately constant despite variations in the tilt angle of the top plate.

The present invention can be embodied variously within the scope thereof as defined by the appended claims and is of course not limited to the drawings and the embodiments described above.

What is claimed is:

1. A tiltable table having a top plate tiltably mounted on a frame, the tiltable table comprising:

an air spring disposed between the frame and the top plate and having a cylinder pivoted at its one end to the frame, a piston rod pivoted at its outer end to the rear side of the top plate and a release pin projecting from the piston rod outer end, the piston rod being holdable as projected by a desired length by the air spring, a lever pivoted to the top plate at the free end thereof, a pushing plate movable toward and away from the release pin of the air spring, having a base end pivoted to the outer end of the piston rod of the air spring and a forward end connected to a remote flexible wire, and the release pin of the air spring is opposed to an intermediate position between the pivoted point of the pushing plate and a point of connection of the pushing plate to the remote flexible wire, the remote flexible wire comprising an outer tube and an inner wire member, the outer tube having one end connected to a fixing member in the vicinity of the pivoted portion of the lever and the other end connected to the outer end of the piston rod, the inner wire member having one end connected to the lever and the other end attached to the pushing plate for pressing the pushing plate into contact with the release pin of the air spring when the lever is pivotally moved to thereby release the piston rod from the holding action of the air spring.

2. A tiltable table having a top plate tiltably mounted on a frame, the tiltable table comprising:

an air spring disposed between the frame and the top plate and having a cylinder pivoted at its one end to the frame, a piston rod pivoted at its outer end to the rear side of the top plate and a release pin projecting from the piston rod outer end, the piston rod being holdable as projected by a desired length by the air spring, a pushing plate movable toward and away from the release pin of the air spring, a lever pivoted to the top plate at the free end thereof, release means attached at its one end to the base end of the lever and at the other end thereof to the pushing plate for pressing the pushing plate into contact with the release pin of the air spring when the lever is pivotally moved to thereby release the piston rod from the holding action of the air spring, and a pivoted at one end to the frame and having a contact face formed on a forward end thereof and bearing on the pivot connecting the outer end of the piston rod to the rear side of the top plate, a spring wire being in the form of a bent resilient metal member and having one end engaged with the frame and the other end engaged with the pawl plate for biasing the contact face into pressing contact with the pivot, the contact face being formed with a shallow recessed portion fittable to the pivot connecting the outer end of the piston rod to the rear side of the top plate when the top plate is at a predetermined tilt angle.

3. A tiltable table having a top plate tiltably mounted on a frame, the tiltable table comprising:

an air spring disposed between the frame and the top plate and having a cylinder pivoted at its one end to the frame, a piston rod pivoted at its outer end to the rear side of the top plate and a release pin projecting from the piston rod outer end, the piston rod being holdable as projected by a desired length by the air spring, a pushing plate movable toward and away from the release pin of the air spring, a lever pivoted to the top plate at the free end thereof, release means attached at its one end to the base end of the lever and at the other end thereof to the pushing plate for processing the pushing plate into contact with the release pin of the air spring when the lever is pivotally moved to thereby release the piston rod from the holding action of the air spring; and a lock member pivoted to the lever and having an arm-length approximately equal to a distance between the rear side of the top plate from the lever so that the lock member may be pivoted against the rear side of the top plate, temporarily preventing the manipulation of the lever.

* * * * *

UNITED STATES PATENT AND TRADEMARK OFFICE

CERTIFICATE OF CORRECTION

PATENT NO. : 5,131,333

DATED : July 21, 1992

INVENTOR(S) : RYUJI KARASAWA, KENKO YAMAGA and YOSHIKAZU TABAYASHI

It is certified that error appears in the above-identified patent and that said Letters Patent is hereby corrected as shown below:

Column 2, line 58, --54-- should be inserted after "and".

Claim 2, column 4, line 67, --pawl plate-- should be inserted after the first occurrence of "a".

Signed and Sealed this

Twenty-third Day of August, 1994

*Attest:*

*Attesting Officer*

BRUCE LEHMAN

*Commissioner of Patents and Trademarks*